US008714099B1

(12) United States Patent
Manderfeld

(10) Patent No.: US 8,714,099 B1
(45) Date of Patent: May 6, 2014

(54) PONTOON FRAMING SYSTEM

(76) Inventor: Raymond M. Manderfeld, Granger, IN (US)

( * ) Notice: Subject to any disclaimer, the term of this patent is extended or adjusted under 35 U.S.C. 154(b) by 294 days.

(21) Appl. No.: 13/269,964

(22) Filed: Oct. 10, 2011

Related U.S. Application Data

(60) Provisional application No. 61/391,264, filed on Oct. 8, 2010.

(51) Int. Cl.
*B63B 1/00* (2006.01)

(52) U.S. Cl.
USPC ..... 114/292; 114/356

(58) Field of Classification Search
USPC ..... 114/61.1, 61.2, 61.22, 264, 267, 292, 114/352, 356; 228/147, 158
See application file for complete search history.

(56) References Cited

U.S. PATENT DOCUMENTS 2,124,246 A * 7/1938 Ebell ..... 105/264
3,673,976 A * 7/1972 Reynolds ..... 114/61.22
4,768,456 A * 9/1988 Jones et al. ..... 114/266
5,355,825 A * 10/1994 Lefebvre et al. ..... 114/267
6,898,955 B1 * 5/2005 Davenport ..... 72/51
7,086,345 B2 * 8/2006 Moses ..... 114/263
7,587,986 B2 * 9/2009 Neidert et al. ..... 114/61.15
2009/0293790 A1 * 12/2009 Bogard et al. ..... 114/61.2

* cited by examiner

*Primary Examiner* — Lars A Olson
*Assistant Examiner* — Anthony Wiest
(74) *Attorney, Agent, or Firm* — Botkin & Hall, LLP

(57) ABSTRACT

A pontoon framing system using complimentary cross members and pontoons to form a pontoon frame. Making the pontoon is done by providing a flat sheet of material that has lateral edges. Rectangular notches extending inwardly at lateral edges are located opposite each other. The sheet is rolled into a cylinder so the notches in the sheet form a notch into the final cylinder that forms a central portion to the pontoon. The lateral edges are joined, and this is typically done by welding. A cross member having a rectangular cross section is placed into the notch formed in the cylindrical central portion. The cross member is then joined to the cylinder.

The complimentary shape of the cross member and pontoon may also be produced by having a cylindrical central portion and then removing an arcuate portion of material in the cross member to match the shape of the pontoon.

1 Claim, 4 Drawing Sheets

FIG. 6
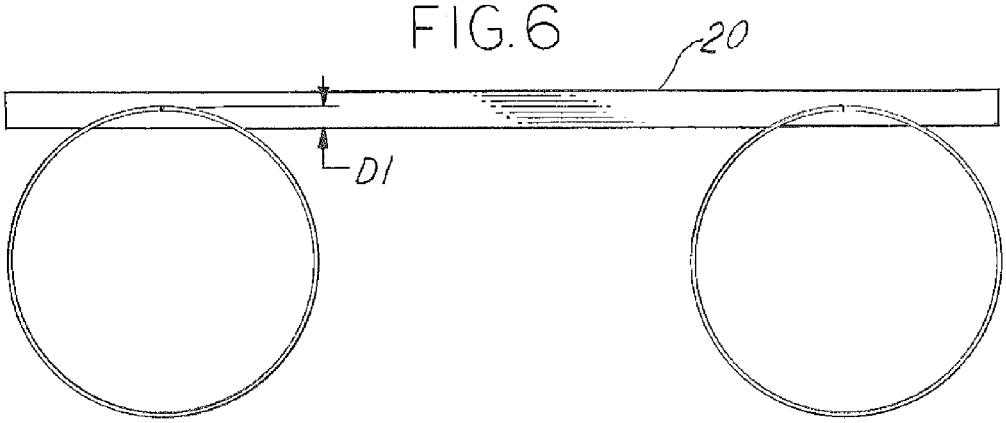
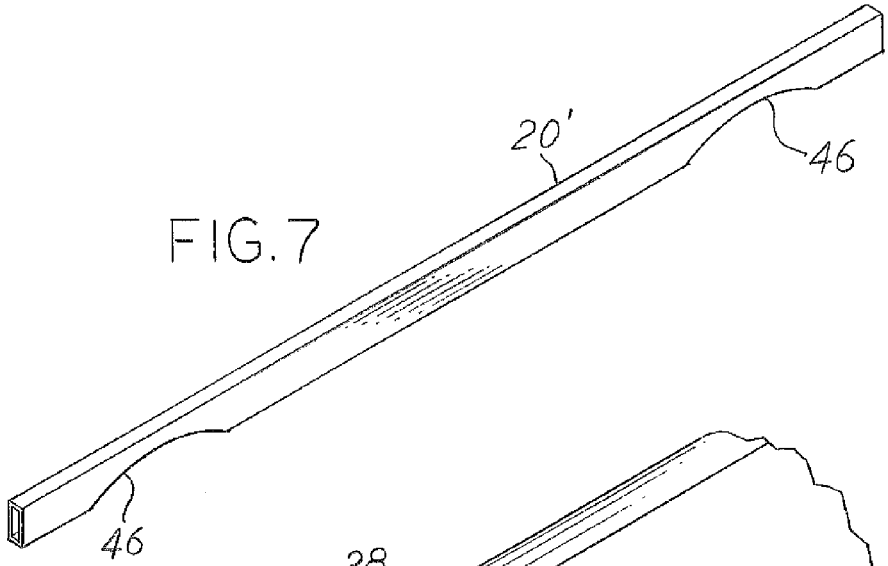
FIG. 7
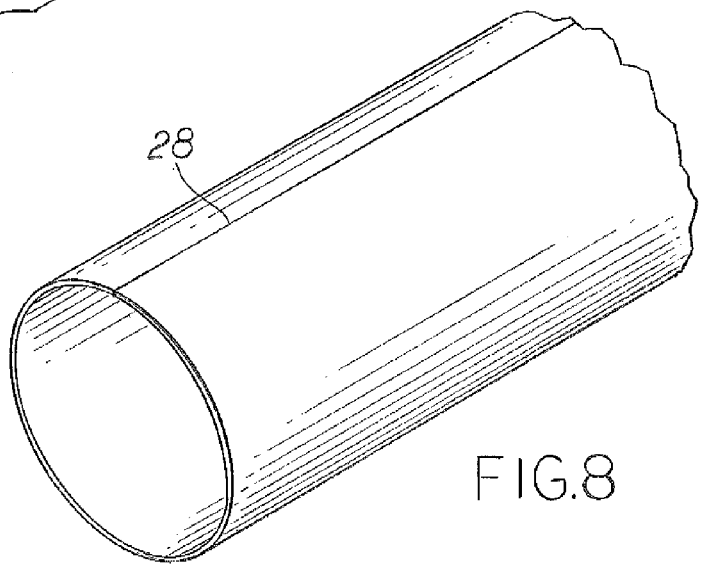
FIG. 8

PONTOON FRAMING SYSTEM

CROSS REFERENCE TO RELATED APPLICATIONS

This application claims the benefit of U.S. Provisional Application No. 61/391,264, filed Oct. 8, 2010, the disclosure of which is hereby incorporated by reference.

BACKGROUND

Having a rigid structure on which to build a pontoon boat is essential to the overall quality of the boat. A flimsy frame can easily be felt by end users as the boat flexes during use. Such flexing can damage walls and other installed components affixed to the deck. A major challenge in creating a rigid structure is having a light structure as well. Rigidity and low weight are competing goals because often having a rigid frame means adding more material and, therefore, more weight.

Traditional methods of construction typically involve using unwieldy brackets on top of round pontoons. This is done to join a straight tubular cross member to a round pontoon. Doing so requires a great amount of labor because connections must be made between the cross members and their corresponding brackets, then the brackets must also be joined to the pontoon. Using brackets does not provide an efficient method of producing a rigid pontoon frame.

SUMMARY OF THE INVENTION

A pontoon framing system makes use of complimentary cross members and pontoons to form a pontoon frame. The frame of the present invention can be made by providing a flat sheet of material that has lateral edges. Rectangular notches are located opposite each other at the lateral edges and extend inwardly within the sheet. The sheet is rolled into a cylinder so the notches in the sheet form a notch into the final cylinder that forms a central portion to the pontoon. The lateral edges are joined, and this is typically done by welding. A cross member having a rectangular cross section is placed into the notch formed in the cylindrical central portion. The cross member is then joined to the cylinder.

Another way that the complimentary shape of the cross member and pontoon may be produced is to have a cylindrical central portion and then remove an arcuate portion of material in the cross member to match the shape of the pontoon.

BRIEF DESCRIPTION OF THE DRAWINGS

FIG. 6 is front view of the central portions of the pontoons connected with cross members using a notched central portion;

FIG. 7 is a front perspective view of a notched cross member;

FIG. 8 is a perspective view of a cylindrical pontoon central portion having no notches;

DETAILED DESCRIPTION OF THE PREFERRED EMBODIMENT

Figure 1:
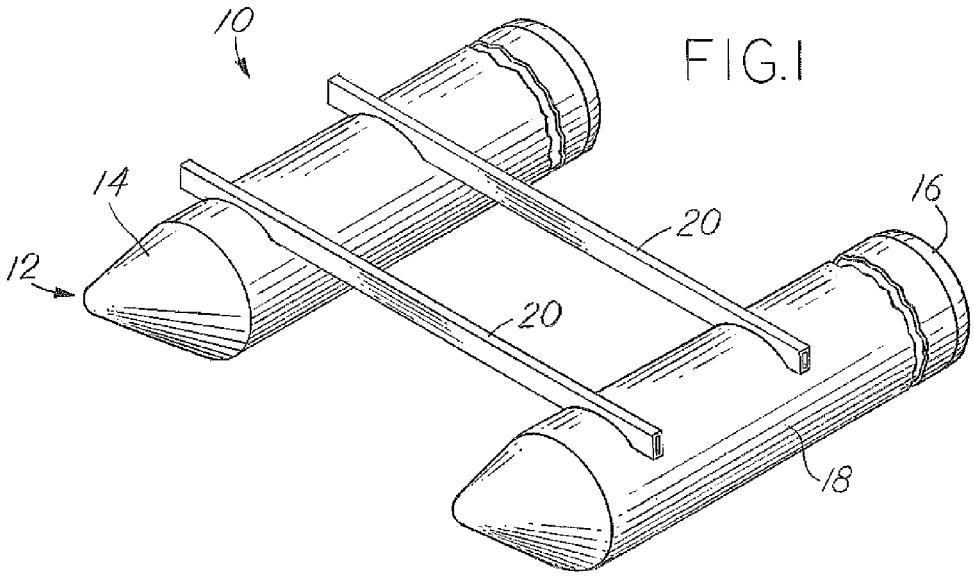
FIG. 1 is a perspective view of the pontoon framing system.

The present invention is a pontoon framing system 10 for use in constructing a pontoon boat. The frame 10 has at least two elongate pontoons 12 that are shown in FIG. 1. Each pontoon 12 has a nose cone 14 that caps the front end of the pontoon 12 and an end cap 16 that are affixed to a central portion 18. The central portion 18 is cylindrical but could have a non-circular cross section. Cross members 20 span the pontoons 12 and are joined to the upper portion of the central portion 18 of each pontoon 12. The cross members 20 are tubular and typically made from aluminum, but other materials may be used as well.

Figure 4:
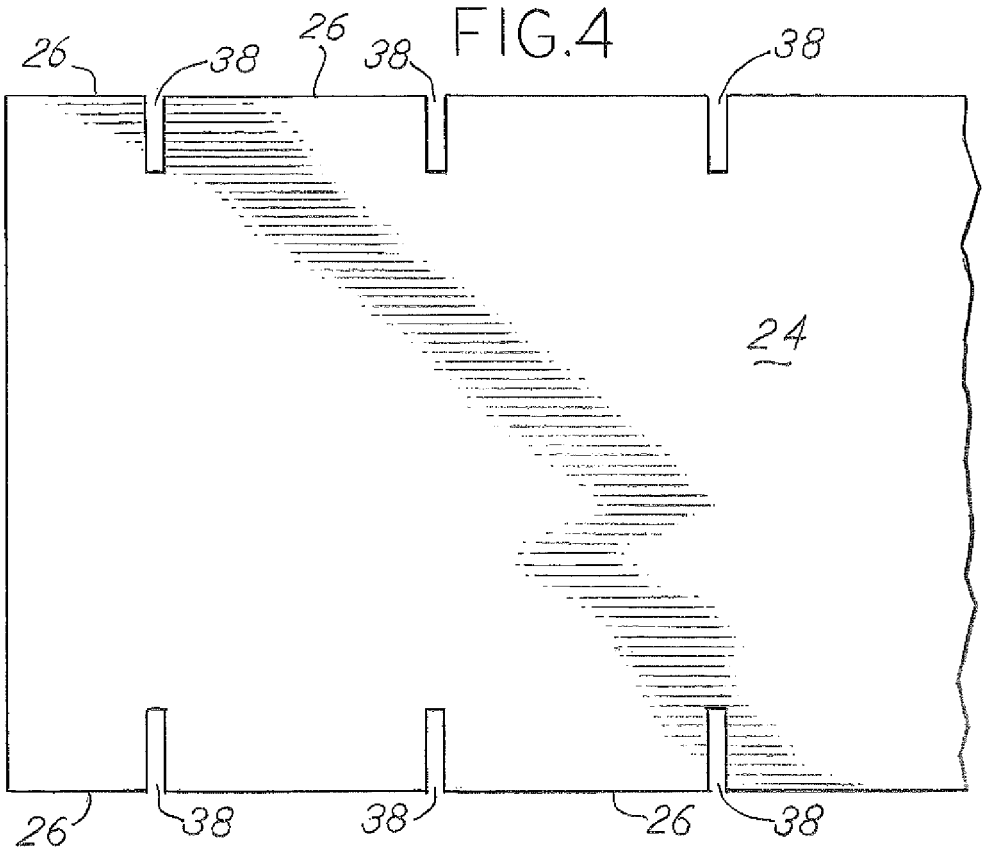
FIG. 4 is a view of a segment of a flat sheet used to form the central portion shown in FIG. 3 having apertures along its lateral edges.

The pontoons 12 are made from a sheet 24 of aluminum having lateral edges 26. The sheet 24 used to make a pontoon 12 according to the present invention is shown in FIG. 4. The sheet 24 is rolled into a cylinder until the lateral edges 26 touch. Once the edges 26 are touching, the edges 26 are welded together. The seam 28, where the edges 26 are welded together to form a central portion 18, is placed near the top of the pontoon 12. The nose cone 14 and end cap 16 are welded to the ends of the central portion 18 to form an enclosed pontoon 12. Although, round pontoons 12 are shown as examples thorough this patent, the complementary nature between cross members 20 and pontoon 12 may be done with non-round cross sectional pontoons as is done in U.S. Pat. No. 7,739,975 ('975 patent), which is hereby incorporated by reference. The method of forming a pontoon as that in the '975 patent or rolling round pontoons 12 produces a pontoon 12 that has no joints between the nose cone 14 and end cap 16 opposite the seam 28. Since the seam 28 is located at the top of the pontoon 12, the only joints that will be in the water during use of the pontoon 12 are where the nose cone 14 and end cap 16 join the central portion 18. This is important as the joining is usually done by welding and minimizing the welds' exposure to water reduces the likelihood a pontoon 12 will leak. The central portion 18 can also be made of multiple smaller cylinders as is often done in traditional construction and in this case there will be welds around the perimeter of the central portion between the nose cone and end cap.

Figure 2:
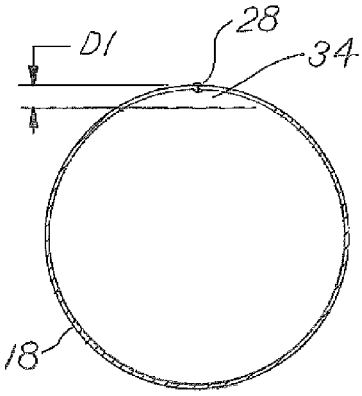
FIG. 2 is a sectional view taken about the line 2-2 in FIG. 1.
Figure 3:
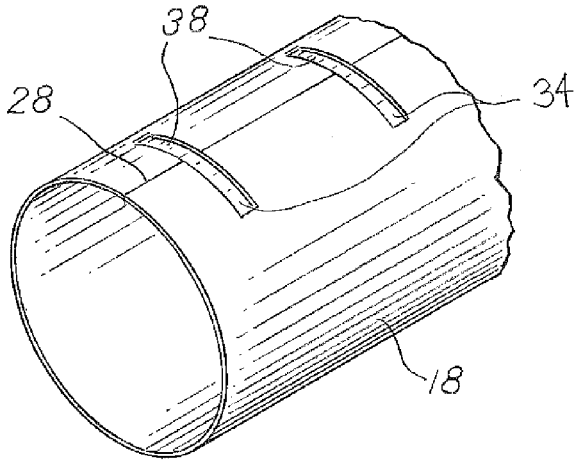
FIG. 3 is a perspective view of a central portion of pontoon having slots for accepting a cross member.

The cross members 20 are welded to the central portions 18. Each cross member 20 is designed to have a complementary shape to the central portion 18 where the cross member 20 is joined. FIG. 2 shows a cross section of a central portion 20 having a slot 34 that complements a rectangular tube type cross member 20. The slot 34 in the central portion may be formed in different ways. One way to form the slot 34 is to have sheet 24, as shown in FIG. 4. In this case, slots 38 are located at the lateral edges and extend inward into the sheet 24. Each slot 38 is half of the total distance needed to be cut inward on the sheet 24 to produce the final slot 34 in the pontoon 12. When the sheet 24 is formed into the cylindrical central portion 18, the lateral edges 26 will meet and the slots 38 will be aligned to form a single slot 34 in the finished central portion 18. The result of forming the central portion 18 this way is shown in FIG. 2. The depth of the slot 34 in the finished central portion is controlled by the distance that the opposite slots 38 extend inward of the lateral edges 26. This yields a slot 34 having a depth D1 with a flat bottom. This shape of slot shown in FIG. 2 is complementary to a standard rectangular tube that is used to make a cross member 20 that will be received within the slot 34. The distance D1 from the bottom of the slot 34 to the top of the pontoon may be increased by increasing the length the slots 38 extend inwardly from their respective lateral edges 26. Depending on the construction of the pontoon boat to be made from the framing system 10 it may be desirable to have different values for D1. Having a distance D1 to the tops of the pontoons 12 provides a similar relationship between the tops of the cross members 20 and the tops of the pontoons 12 as would be achieved with the traditional method of using brackets to join cross members to the tops of the pontoons. This is especially true when D1 is shallow enough that the cross members 20 extend above the pontoons 12 as shown in FIG. 6. This enables the framing system 10 of this invention to be used on an assembly line designed for the traditional method of using brackets for mounting the cross members 20. It is even possible to have the slots 38 in the sheet 24 be of an appropriate length to create a D1 so that the top of the cross members 20 are aligned with the top of the pontoon 12. This occurs when D1 is the same as the height of the cross member 20.

Figure 5:
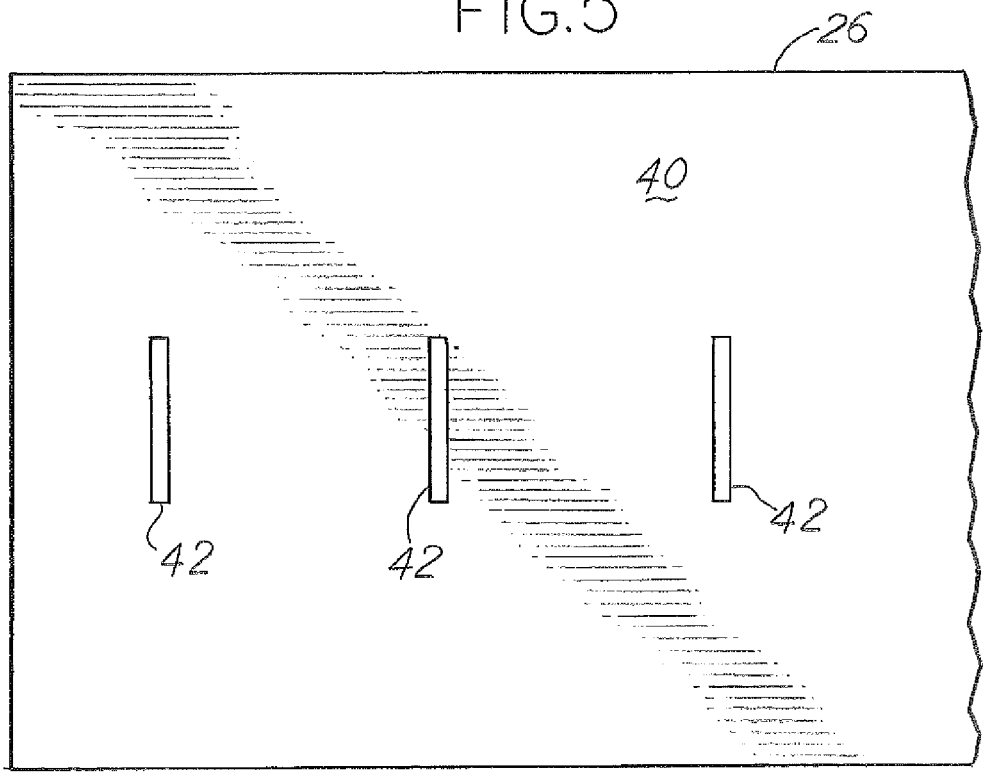
FIG. 5 is a view of a segment of a flat sheet having rectangular apertures between its lateral edges.

Another way to form the slot 34 in the central portion 18, as shown in FIG. 2, is to have a rectangular slot 42 located between the lateral edges 26 within the sheet 40. Such a sheet 40 is shown in FIG. 5. This sheet 40 is then rolled into a cylindrical central portion 18 with the rectangular slots 42 on the upper portion of the central portion, resulting in slot 34 that is complementary to the rectangular cross member 20. The distance D1 is controlled by the length of the slot 42. Longer slots 42 will yield a deeper D1.

Yet another to form slots in the pontoon 12 is to cut slots 34 after the pontoon 12 is formed. In this case, a sheet having no notches 38 or 42 is formed into a central portion 18, then slots 34 are cut.

Figure 9:
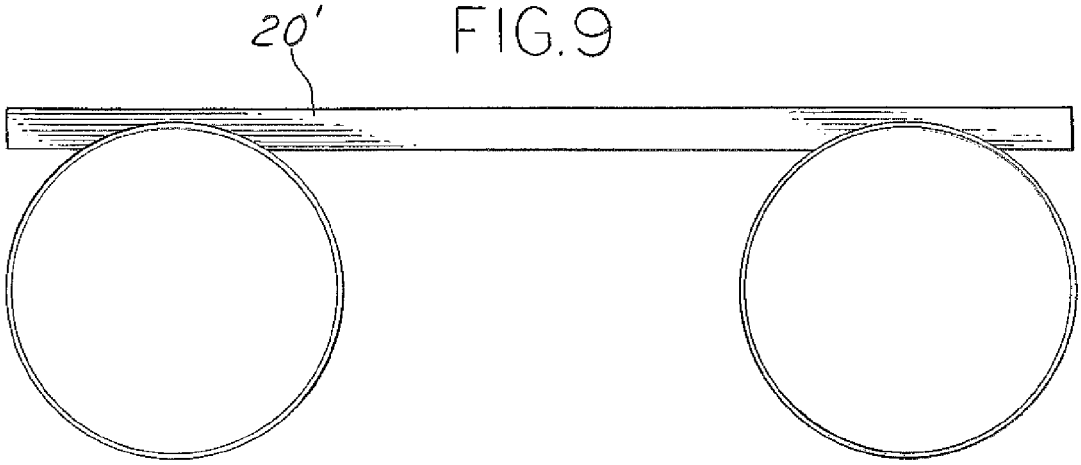
FIG. 9 is a front view of another embodiment of the pontoon framing system having notched cross members.
Figure 10:
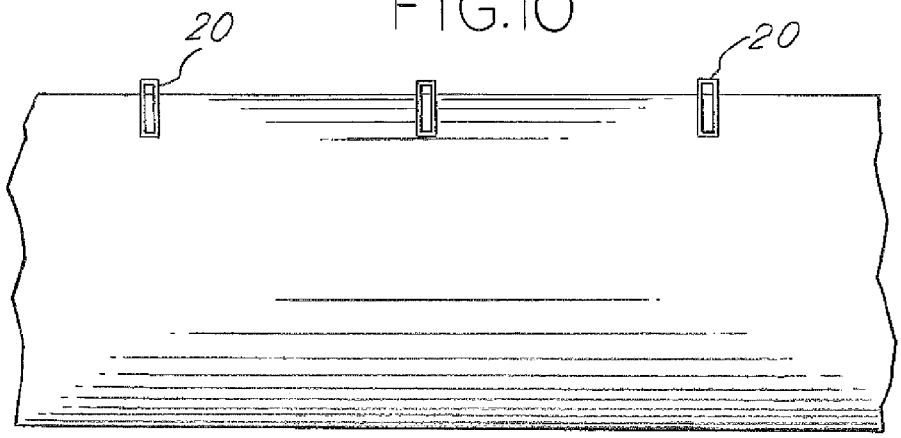
FIG. 10 is a side view of the pontoon framing system shown in FIG. 9.
Figure 11:
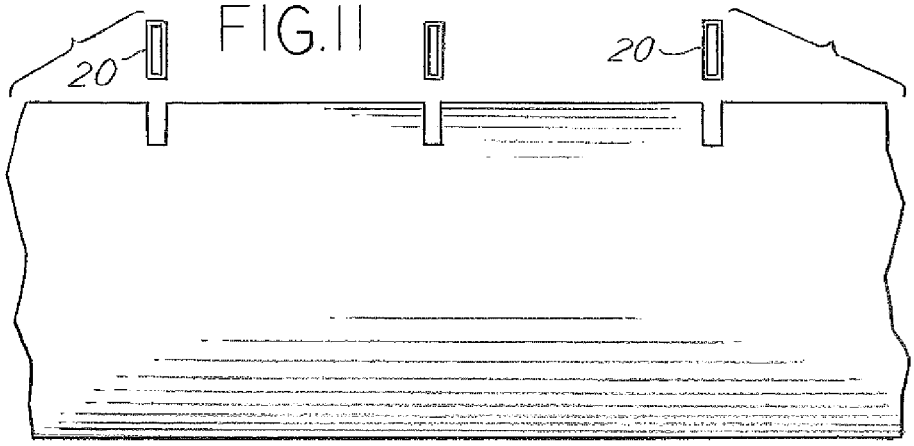
FIG. 11 is an exploded side view of the pontoon framing system shown in FIG. 6.

Still another way to form a complementary relationship with the cross member 20' and central portions 18 may be done by using notches 46 in the cross members 20'. The notched cross members are generally indicated by numeral 20'. FIG. 7 shows a notched cross member 20'. The notches 46 are arcuately shaped to match the curvature of the central portion 18. A central portion 18 having no notches, as shown in FIG. 8, is mated with cross members 20', as shown in FIG. 9, to yield the structure shown in FIG. 9.

With any of the methods of construction for pontoons mentioned above, welds are made where the cross members 20, 20' meet the upper portions of the central portions 18. In any of the cases mentioned above, the pontoon framing system 10, built by such methods, has the outward appearance of that shown in FIG. 1. This results in a strong, lightweight frame 10 on which a pontoon boat may be built. A deck may be placed on the cross members 20 using traditional construction techniques used in the pontoon boat industry.

The invention is not limited to the details given above, but may be modified within the scope of the following claims.

What is claimed is:

1. A method of producing a pontoon frame comprising the steps of:

providing a flat elongate sheet of material having lateral edges and having rectangular notches opposite each other as said lateral edges;

rolling said sheet into a cylinder so said notches in said sheet meet and said lateral edges touch to form a notch in said cylinder;

closing the ends of said cylinder by adding a nose cone at one end of the cylinder and an end cap at an opposite end of the cylinder to form a pontoon;

joining said lateral edges;

providing a rectangular cross member;

placing said cross member into said notch in said cylinder;

joining said cross member to said cylinder;

wherein said cross member is joined to a plurality of cylinders spaced apart; and wherein said pontoon has no joints opposite said cross member between the nose cone and the end cap.

* * * * *